US005154577A

United States Patent [19]

Kellock et al.

[11] Patent Number: 5,154,577

[45] Date of Patent: Oct. 13, 1992

[54] FLEXIBLE THREE-PIECE SEAL ASSEMBLY

[75] Inventors: Iain R. Kellock, Hamilton; Andrew D. Kemp, Mason, both of Ohio

[73] Assignee: General Electric Company, Cincinnati, Ohio

[21] Appl. No.: 642,739

[22] Filed: Jan. 17, 1991

[51] Int. Cl.[5] ..... F01D 5/20

[52] U.S. Cl. ..... 415/170.1; 415/134; 277/192; 277/236

[58] Field of Search ..... 415/115, 116, 170.1, 415/134–139; 277/236, 192

[56] References Cited

U.S. PATENT DOCUMENTS

| | | | |
|---|---|---|---|
| 187,762 | 2/1877 | Kelley | 277/192 |
| 2,915,280 | 12/1959 | Sonder | 415/138 |
| 3,062,499 | 11/1962 | Peterson | 253/78 |
| 3,519,366 | 7/1970 | Campbell | 415/138 |
| 3,542,483 | 11/1970 | Gragliardi | 415/139 |
| 3,728,041 | 4/1973 | Bertelson | 415/189 |
| 3,752,598 | 8/1973 | Bowers et al. | 415/173 |
| 3,754,766 | 8/1973 | Asplund | 277/236 |
| 4,314,792 | 2/1982 | Chaplin | 415/116 |
| 4,314,793 | 2/1982 | DeTolla et al. | 415/135 |
| 4,318,668 | 3/1982 | Chaplin et al. | 415/135 |
| 4,537,024 | 8/1985 | Grosjean | 60/39.161 |
| 4,767,260 | 8/1988 | Clevenger et al. | 415/115 |
| 4,921,401 | 5/1990 | Hall et al. | 415/138 |

*Primary Examiner*—John T. Kwon

*Attorney, Agent, or Firm*—Jerome C. Squillaro; John R. Rafter

[57] ABSTRACT

A three-piece seal assembly is disclosed for sealing cooling air leakage between circumferentially spaced-apart flowpath segments in gas turbine engines. First and second seals are disposed in oppositely facing slots on adjacent flowpath segments, and extend between adjacent flowpath segments to restrict cooling flow between the segments. A third seal member having first and second leg portions in abutting engagement with the first and second seals restricts leakage flow between the gap between the first and second seals.

10 Claims, 7 Drawing Sheets

FLEXIBLE THREE-PIECE SEAL ASSEMBLY

BACKGROUND OF THE INVENTION

1. Field of the Invention

The present invention relates generally to reducing cooling air leakage between adjacent flowpath segments in gas turbine engines, such as leakage between adjacent turbine nozzle segments. More particularly, the invention relates to a flexible three-piece seal assembly which can include first and second spline seals in abutting engagement with a third seal member.

2. Description of Known Art

Gas turbine engines typically include nozzle diaphragms and shroud assemblies centered about the engine's axis and forming annular flowpath boundaries within the engine. Due to the large temperature differentials encountered during engine operation, these nozzles and shrouds are typically designed as an assembly of circumferentially spaced-apart segments with gaps extending between adjacent segments. The gaps accommodate differential thermal growth and reduce thermal stress in the flowpath segments.

These flowpath segments are generally exposed to high temperature gas flows and are typically cooled with high pressure cooling air bled from an upstream compressor. Such cooling air bled from the compressor is parasitic and must be minimized to the extent possible to maximize engine efficiency. As a result, it is highly desirable to reduce cooling air leakage through the circumferentially extending gaps between nozzle segments and other flowpath segments.

Various seal designs are known for providing sealing between flowpath segments in gas turbine engines, such as those designs shown in U.S. Pat. Nos. to Bertelson (3,728,041), Grosjean (4,537,024), Bowers et al. (3,752,598), and Clevenger et al (4,767,260).

Sealing arrangements using spline or feather seals are commonly used in gas turbine engines. Such seals are typically disposed in pairs of oppositely facing grooves electro-discharge machined in oppositely facing surfaces on adjacent flowpath segments. Such seals are flexible and include some freedom of movement in their respective grooves to accommodate manufacturing tolerances, surface roughness in the grooves, and misalignment or movement between adjacent flowpath segments. Seals which are not flexible will not seat properly in the grooves, resulting in leakage and wasted cooling flow.

In addition, two such seals may be used in combination to seal leakage flow in both a generally radial and a generally axial direction between adjacent flowpath segments. Prior seal assemblies have been ineffective, however, since they typically include a leakage path between the two seals, or introduce stiffness to the seal assembly, or couple the motion of one seal with the motion of another seal.

SUMMARY OF THE INVENTION

Accordingly, a primary object of the present invention is to provide a three-piece seal assembly which reduces leakage between adjacent circumferentially spaced-apart flowpath segments.

Another object of the invention is to provide a flexible seal assembly which can accommodate misalignment between such segments, and also accommodate machining and dimensional tolerances inherent in such flowpath segment assemblies.

A further object of the invention is to provide a seal assembly which permits relative motion of two seal members while reducing leakage between the two seal members.

Briefly, the present invention provides a seal assembly for restricting flow between adjacent circumferentially spaced-apart flowpath segments, such as turbine nozzle segments, to restrict flow between a region of relatively low temperature, high pressure cooling air and a region of relatively higher temperature, relatively lower pressure gas flow. A first seal member, such as a spline seal, extends between adjacent segments to restrict flow between the segments in a first direction. A second seal member, which may also be a spline seal, is angled with respect to the first seal member and extends between adjacent segments to restrict flow in a second direction. A third seal member extends between the adjacent segments and includes first and second leg portions in abutting engagement with the first and second seal means, respectively, to restrict flow between the first and second seal members. The first and second leg portions can be pressurized into abutting engagement with the first and second seal means by the pressure differential between the higher pressure cooling region and the relatively lower pressure gas flow. The third seal means restricts flow between the the first and second seal means, without adding stiffness to the first and second seal means, and without restricting relative motion between the first and second seal means.

BRIEF DESCRIPTION OF THE DRAWINGS

While the specification includes a series of claims which particularly point out and distinctly claim the subject matter which the applicants consider to be their invention, a more complete understanding of the invention will be gained from the following description which is given in connection with the accompanying drawings, in which:

DETAILED DESCRIPTION OF THE DRAWINGS

Figure 1:
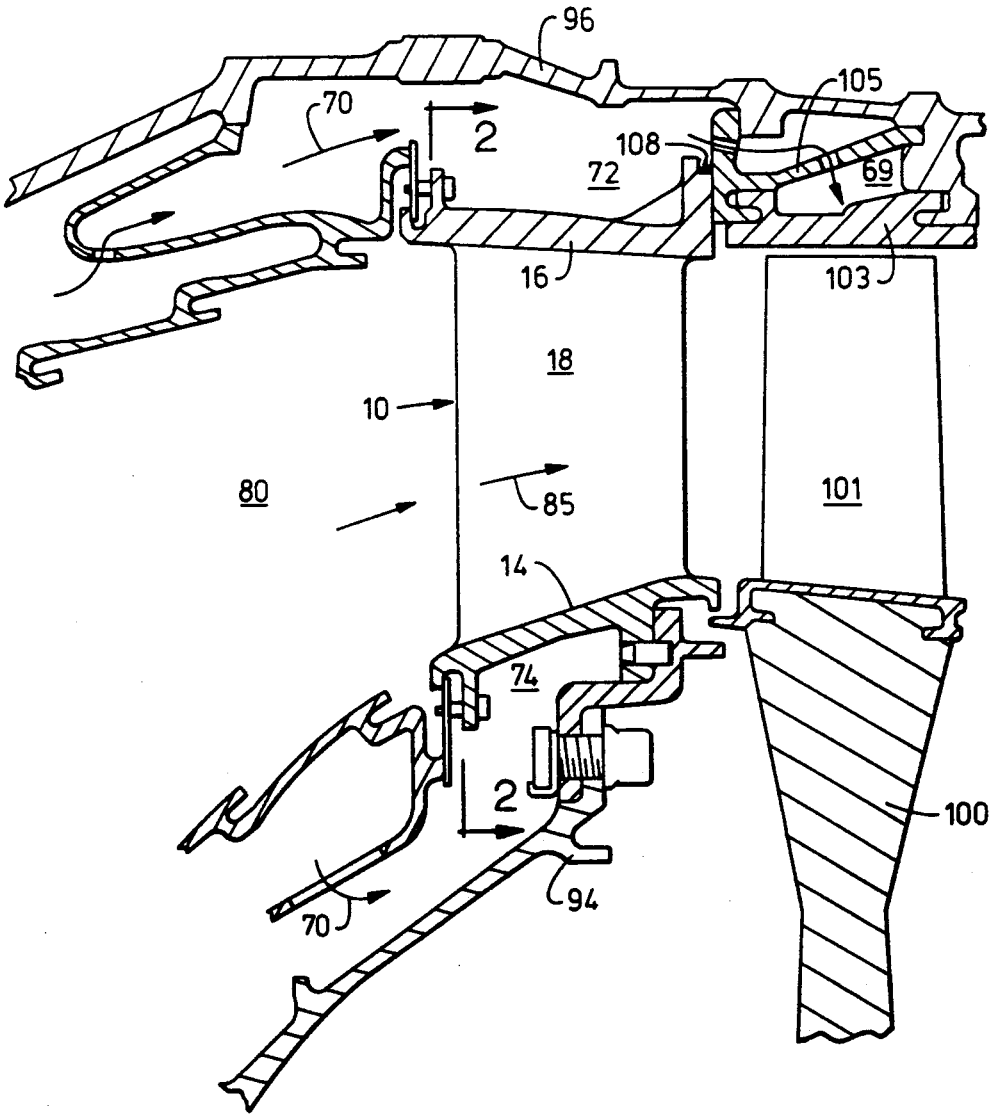
FIG. 1 is an illustration of a partial cross section of a gas turbine engine showing gas flow through a known turbine nozzle assembly and cooling air flow to the nozzle assembly.

FIG. 1 shows an illustration of a typical turbine nozzle assembly, or turbine nozzle diaphragm, 10, mounted from a support structure 94 and positioned intermediate a combustor section 80 and a turbine rotor 100 in a gas turbine engine. A fuel and air mixture burned in combustor 80 forms a relatively high temperature gas flow 85. The stationary nozzle assembly 10 includes vanes 18 extending between an annular outer band 16 and an annular inner band 14. Bands 16 and 14 form annular flowpath boundaries for flow 85. Vanes 18 accelerate gas flow 85 downstream through nozzle assembly 10 and direct flow 85 into a plurality of downstream turbine blades 101 mounted on the perimeter of rotor 100 for rotation about the engine's longitudinal axis. An annular shroud 103 typically provides a flowpath boundary radially outward of blades 101, and may be composed of a plurality of circumferentially spaced-apart segments supported from a plurality of circumferentially spaced apart hanger segments 105 (only one shown) and case 96.

Those skilled in the art realize the need to provide a cooling flow 70, as from an upstream compressor discharge (not shown), to cool nozzle assembly 10. Cooling flow 70 may be provided between combustor 80 and an outer case 96 to supply a region 72 radially outward of band 16 with cooling air having a relatively lower temperature, and a relatively high pressure, with respect to flow 85. Likewise, cooling flow 70 provided between combustor 80 and support structure 94 supplies a region 74 radially inward of band 14 with cooling air. The cooling air may be used to cool the bands and the interior of vanes 18, which are typically hollow. Cooling flow 70 may also supply a region 69 radially outward of shroud 103 to cool the shroud. A resilient seal means, such as a circumferentially extending W seal means 108 may be used to restrict leakage from region 72 between a band 16 and a downstream adjacent hanger 105.

Figure 2:
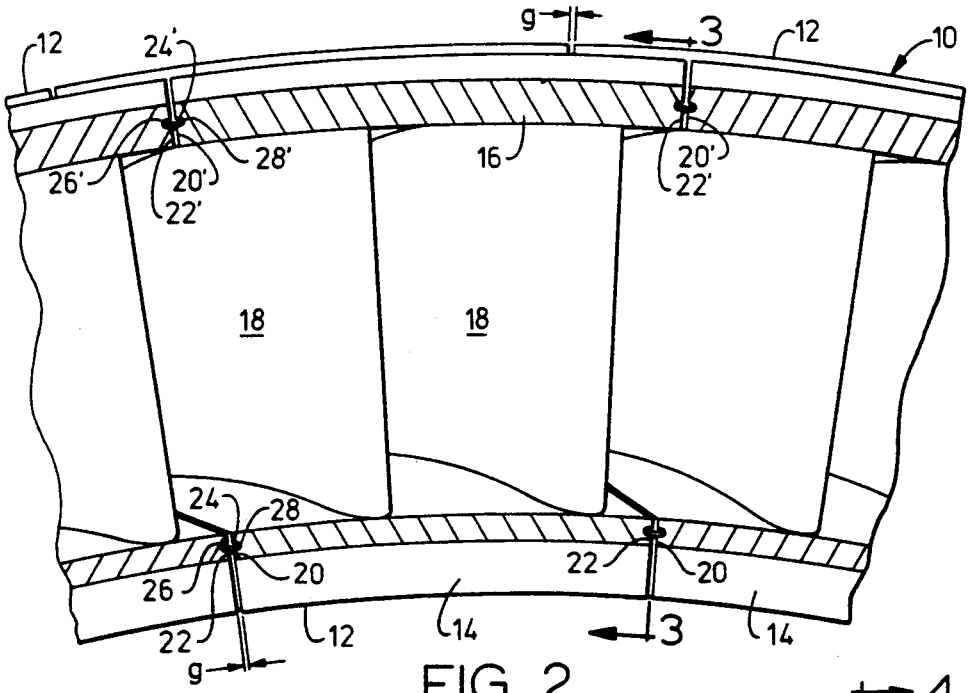
FIG. 2 is an illustration of part of a representative turbine nozzle assembly viewed along line 2—2 in FIG. 1.

FIG. 2 is a front elevation view looking downstream and taken parallel to the engine axis of a portion of a known representative nozzle assembly 10. The nozzle assembly 10 typically comprises a plurality of circumferentially spaced-apart arcuate flowpath segments 12, with adjacent segments 12 separated by gaps g to minimize thermal stress in the nozzle assembly. Each segment 12 includes an outer band 16, and inner band 14, and one or more vanes 18 extending between the bands 14 and 16.

Adjacent segments 12 have a pair of oppositely facing side surfaces 20 and 22 bordering the gap between adjacent inner bands 14, and a pair of oppositely facing side surfaces 20' and 22' bordering the gap between adjacent outer bands 16. It is well known in the art to angle, or skew, the side surfaces of the bands with respect to the engine axis to accommodate the airfoil shape of vanes 18, as shown in FIG. 2. A seal assembly is required to prevent cooling air in regions 72 and 74 from leaking between adjacent nozzle segments 12, such as between surfaces 20' and 22' and between surfaces 20 and 22.

Figure 3:
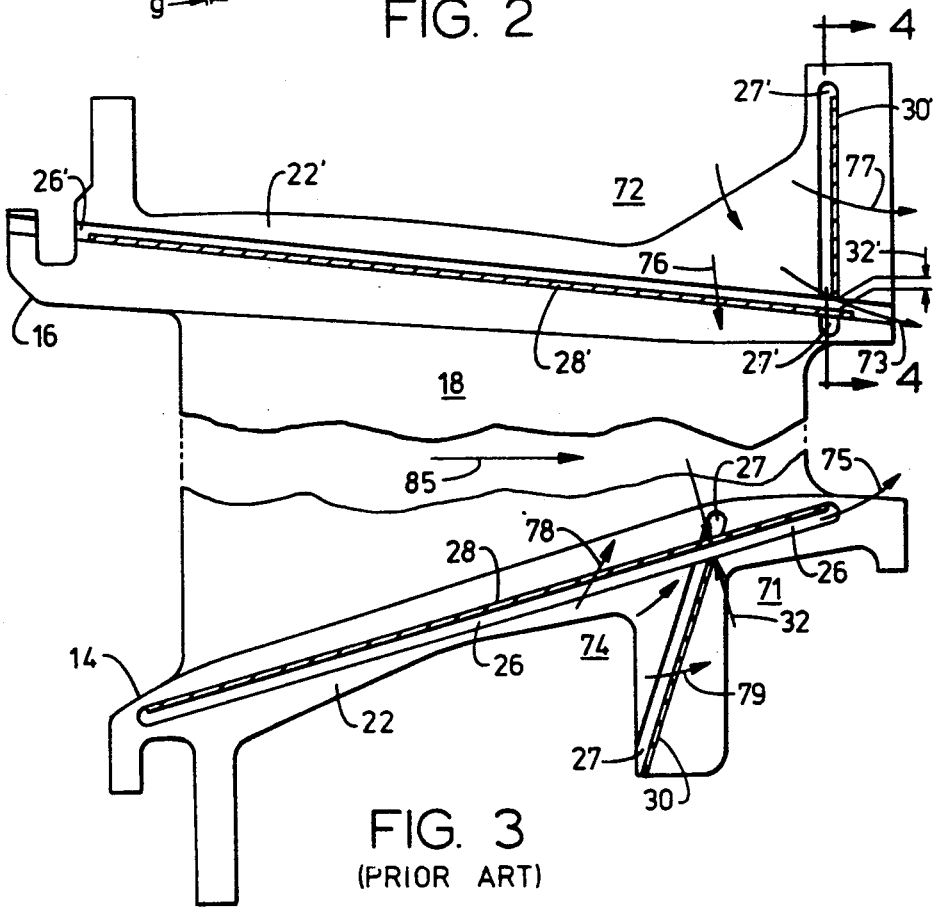
FIG. 3 (PRIOR ART)
FIG. 3 is an illustration of part of an end view of a turbine nozzle segment showing a known sealing assembly; as viewed along line 3—3 in FIG. 2.
Figure 4:
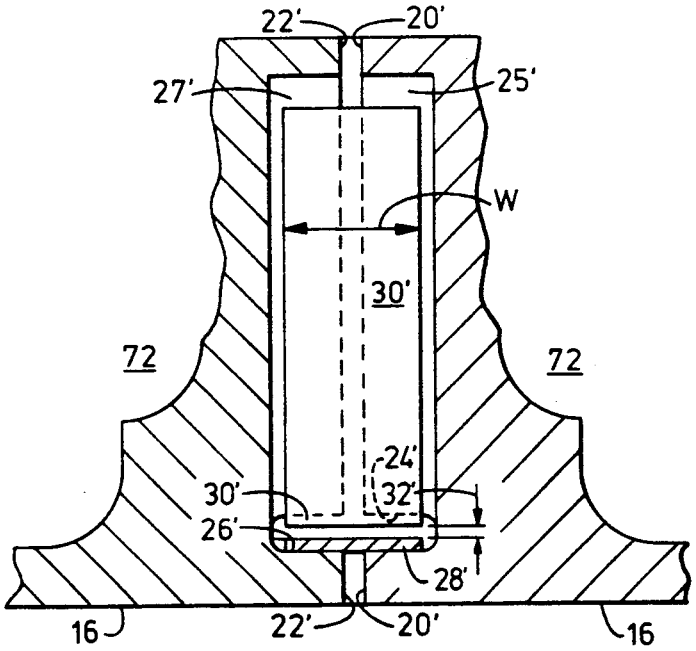
FIG. 4 (PRIOR ART)
FIG. 4 is an illustration of a partial sectional view taken along line 4—4 in FIG. 3.

Referring now to the outer band 16 shown in FIGS. 3 and 4, a known seal arrangement includes a first pair of oppositely facing grooves 24' and 26' in oppositely facing surfaces 20' and 22' on adjacent outer bands 16, and a second pair of oppositely facing grooves 25' and 27' angled with respect to the first pair. Grooves 26' on surface 22' intersects groove 27' on surface 22'. Likewise, groove 24' on surface 20' intersects groove 25' on surface 20'.

A first seal member 28, extends between and is seated in oppositely facing grooves 24' and 26', and a second seal member 30' extends between and is seated in oppositely facing grooves 25' and 27'. Seal members 28' and 30' can be spline seals, which can be substantially straight and flat across their widths W (FIG. 4). Seal member 28' blocks flow of cooling air from region 72 along a first generally radially inward direction 76' and seal member 30' blocks flow of cooling air from region 72 along a second generally downstream direction 77, as shown in FIG. 3.

A similar inner band sealing arrangement is shown in FIG. 3, where inner band sealing elements corresponding to outer band sealing elements are labeled with corresponding unprimed numerals.

The static pressure of gas flow 85 drops rapidly as potential energy in flow 85 is converted to kinetic energy due to the acceleration of flow 85 downstream through nozzle vanes 18. The pressure differential between flow 85 and regions 72 and 74 is less than 10 psi when flow 85 enters the nozzle assembly 10, but can be as much as 200 psi or more at downstream locations where the grooves in side surfaces 20' and 22' (and 20 and 22) intersect. Therefore, sealing is especially critical at the junctions between seal members 28' and 30' and seal members 28 and 30.

The seal members 28' and 30' (and 28 and 30) must be flexible and free to move within their respective grooves to accommodate misalignment between adjacent nozzle segments 12 and to accommodate manufacturing tolerances. The grooves are typically sized longer than their respective seal members to accommodate manufacturing tolerances. In addition, the grooves are typically formed in the side surfaces by electro-discharge machining, electro-chemical machining, or grinding, resulting in a roughness in the groove walls against which the seal members are seated. The seal members should be flexible to accommodate this roughness.

Flat, straight spline seals 28' and 30', as shown in FIGS. 3 and 4, generally provide good. flexibility. However, movement of seals 28' and 30' in their respective slots results in a gap 32' between seals 28' and 30' (FIG. 4). Due to manufacturing tolerances, this gap can be as much as 0.04 inch (40 mils) wide or greater. Cooling air from region 72 can escape through leak path 73' as shown in FIG. 3. A similar gap between seals 28 and 30 on inner band 14 provides a leak path 75. These gaps are especially critical because the pressure differential across the gaps 32' and 32 can be 200 psi, or more, as described above.

Figure 5:
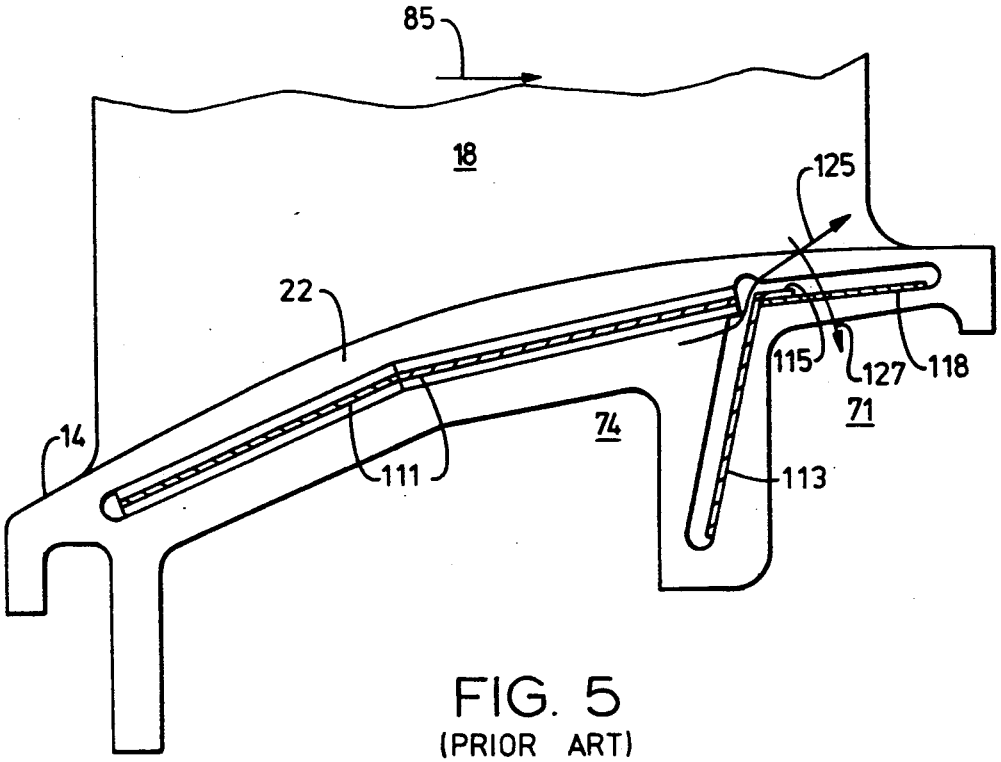
FIG. 5 (PRIOR ART)
FIG. 5 is an illustration of a partial end view of a turbine nozzle segment inner band showing a known sealing assembly.

FIG. 5 shows a known inner band seal assembly which includes a pair of hour glass seals 111 disposed in oppositely facing grooves. Seals 111 block radial flow from region 74 into gas flow 85. Seal member 113 also disposed in oppositely facing grooves blocks axial flow from region 74 to a downstream lower pressure region 71. Flat spline seal 118 disposed in oppositely facing grooves prevents ingestion of flow 85 into region 71, as indicated by arrow 127 in FIG. 5. Seal member 113 includes an integral tab portion 115 which overlaps seal member 118. Tab portion 115 can have a width substantially equal to the widths of seal members 113 and 118.

This assembly includes a number of disadvantages. First, hour glass seals are not flat across their widths but have a curved cross section (see element 131, FIG. 7) and therefore have low flexibility. Second, the seal assembly does not prevent leakage from region 74 along arrow 125 between the aft hour glass seal 111 and seal member 113. Third, seal member 113 is not straight along its length, since it includes integral tab 115 which decreases the flexibility of seal member 113 by acting as a stiffener at the end of seal member 113. Fourth, because tab 115 is integral with seal member 113, motion of seal member 113 can affect, or be coupled with, motion of seal member 113.

Figure 6:
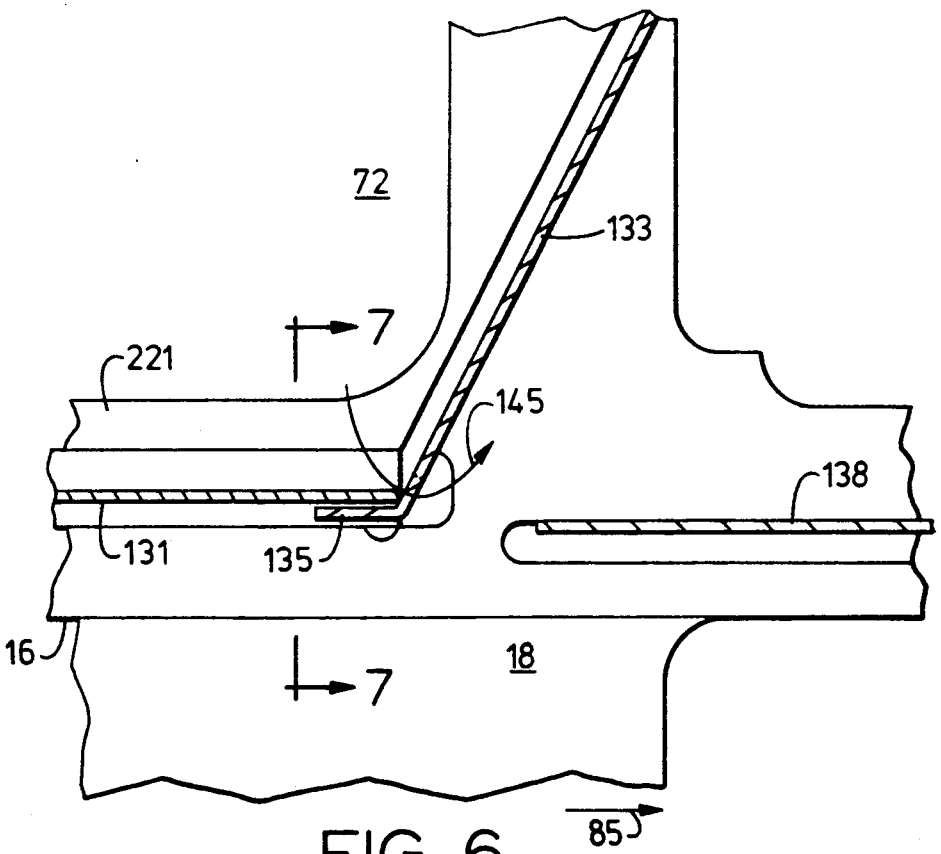
FIG. 6 (PRIOR ART)
FIG. 6 is an illustration of a partial end view of a turbine nozzle outer band showing a known sealing assembly.
Figure 7:
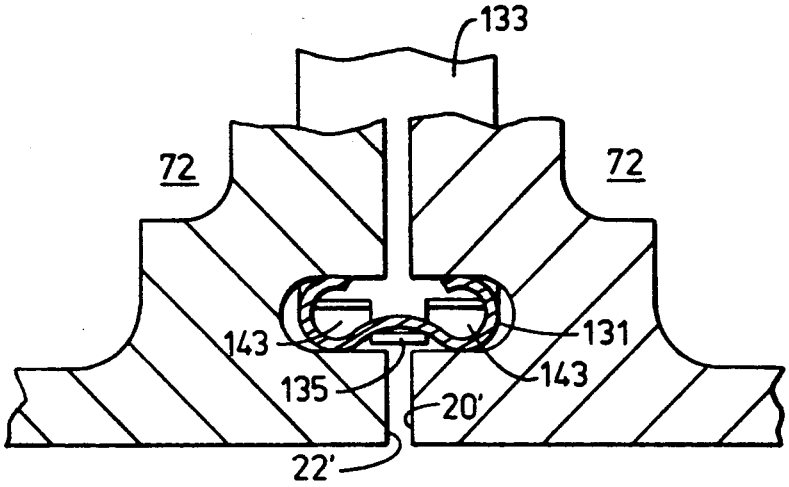
FIG. 7 (PRIOR ART)
FIG. 7 is an illustration of a partial sectional view taken along line 7—7 in FIG. 6.

FIGS. 6 and 7 show a known outer band sealing arrangement including an hour glass seal 131, a seal member 133, and a spline seal 138. Hour glass seal 131 blocks cooling air flow from region 72 into gas flow 85. Spline seal 138 blocks ingestion of gas flow 85 into a downstream lower pressure region not shown. Seal member 133 blocks axial flow of cooling air from region 72, and includes an integral reduced width tab 135 which extends under hour glass seal 131 and restricts seal member 133 from moving away from seal 131.

This assembly also includes a number of disadvantages. First, hour glass seal 131 has low flexibility because it is not flat across its width. Second, integral tab 135 reduces seal member 133 flexibility by acting as a stiffener. Third, hour glass seal 131 and tab 135 provide a leakage path 143 shown in FIG. 7 as indicated by arrow 145 in FIG. 6. Fourth, the pressure in region 72 will tend to force tab 135 away from seal 131, providing an even larger leak path between seal members 133 and 131.

Figure 8:
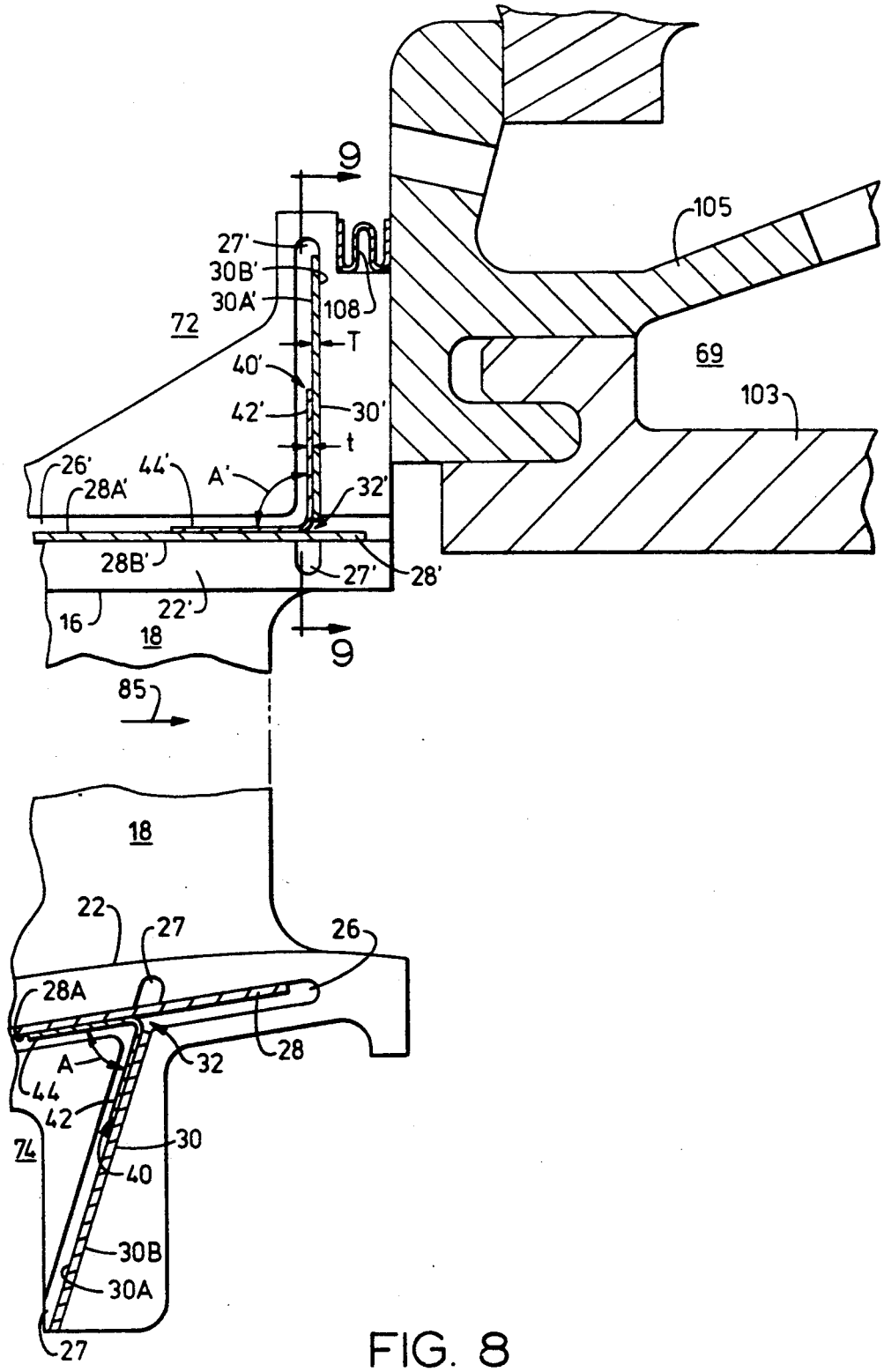
FIG. 8 is an illustration of a partial end view of a turbine nozzle segment in accordance with the present invention.
Figure 9:
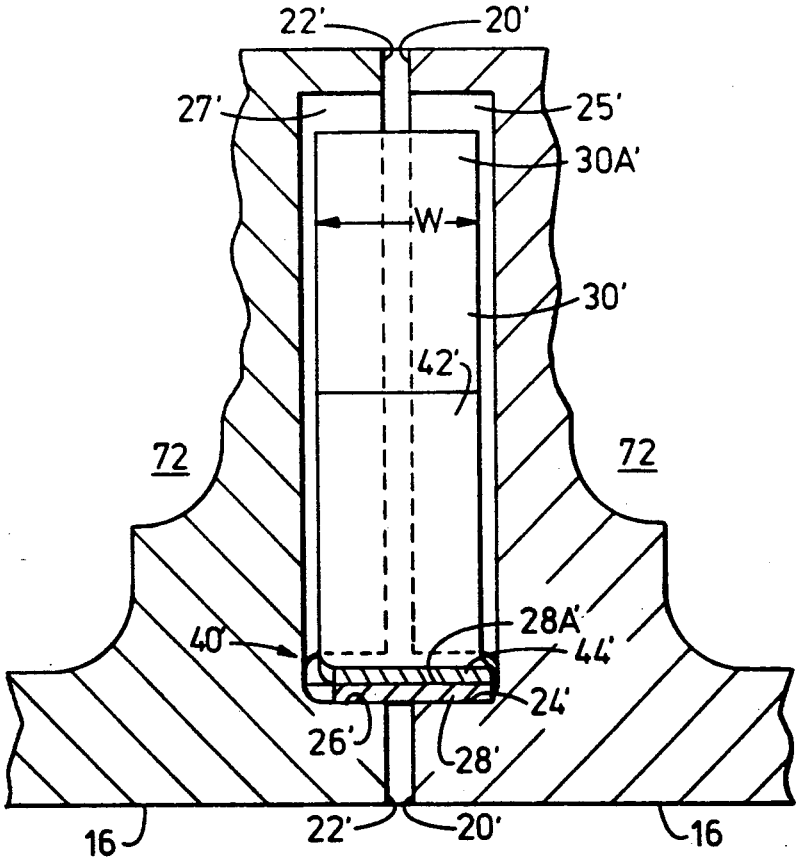
FIG. 9 is an illustration of a partial sectional view of the seal assembly taken along line 9—9 in FIG. 8.
Figure 10:
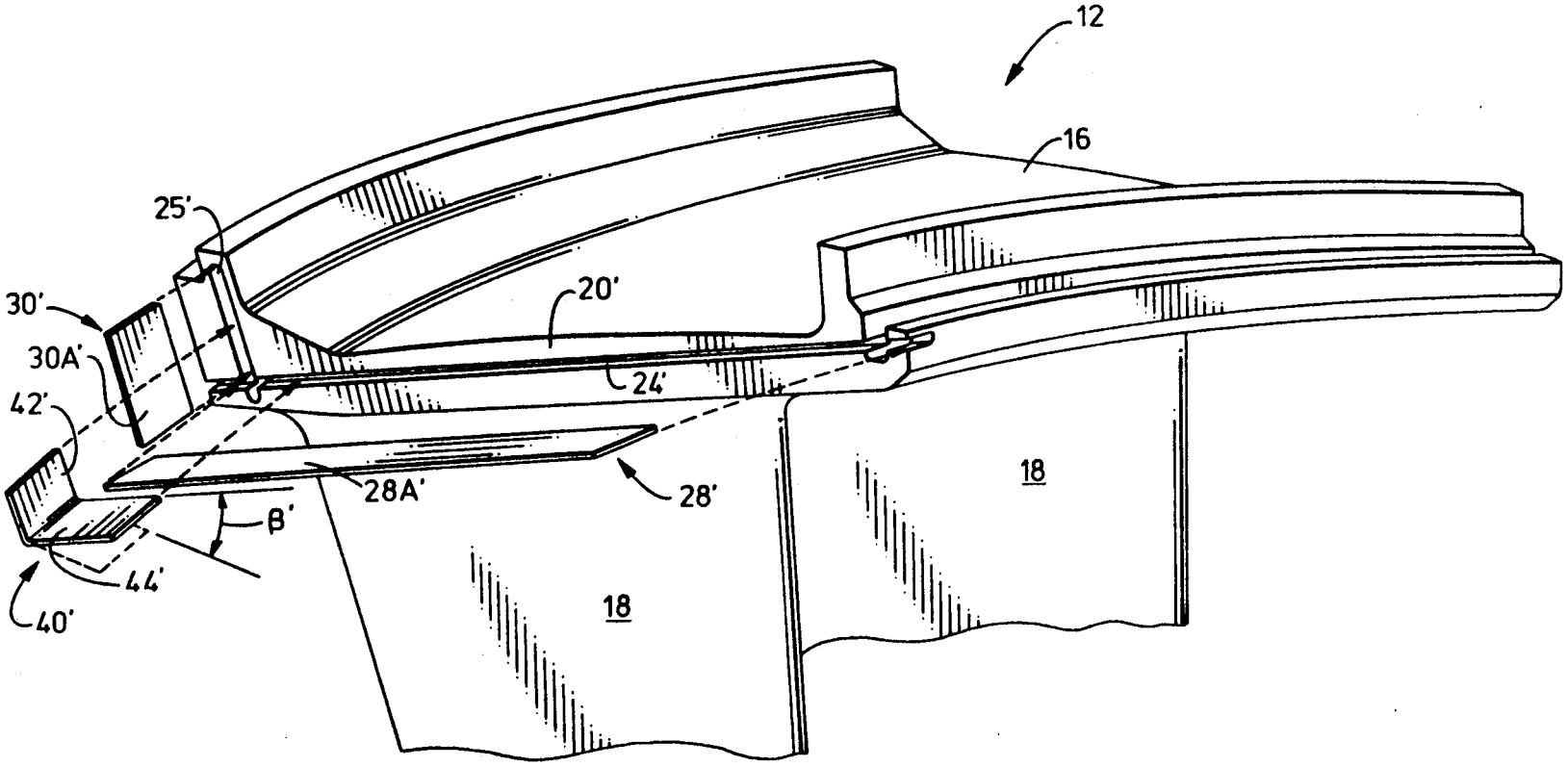
FIG. 10 is a perspective view of the seal assembly in accordance with the present invention.

FIGS. 8, 9 and 10 are illustrations of a three-piece seal assembly in accordance with the present invention. FIG. 8 shows both an inner band and an outer band three-piece seal assembly. The following description, while referring to the outer band seal assembly, will be understood to apply equally well to the inner band seal assembly, where corresponding seal components are indicated by unprimed labels.

In a preferred embodiment, adjacent outer bands 16 on adjacent turbine nozzle segments include a pair of oppositely facing side surfaces 20' and 22'. Surfaces 20' and 22' include a first pair of oppositely facing grooves 24' and 26', and a second pair of oppositely facing grooves 25' and 27'. Grooves 24' and 25' on surface 20' intersect and are angled with respect to each other. Likewise, grooves 26' and 27' on surface 22' intersect and are angled with respect to each other. A first seal means 28' extends between grooves 24' and 26' and includes a seating surface 28B' seated against the walls of grooves 24' and 26'. A second seal means 30' extends between grooves 25' and 27', and includes a seating surface 30B, seated against the walls of grooves 25' and 27'. Seal means 28' and 30' are preferably substantially flat across their respective widths, W, and straight along their lengths, with no lips, tabs, corrugations, or other out-of-plane extensions or protrusions which would increase their stiffness.

A third seal means 40' is preferably disposed in, and extends between, each pair of oppositely facing grooves. Seal means 40' can include a first leg portion 44' and a second leg portion 42'. The first and second leg portions are preferably substantially flat across their widths and straight along their lengths, with no lips, tabs, corrugations, or other out-of-plane extensions or protrusions which would increase their stiffness. First leg portion 44' is preferably in abutting engagement with surface 28A' on the high pressure side of first seal member 28', while second leg portion 42' is in abutting engagement with surface 30A' on the high pressure side of second seal member 30'. The pressure differential between region 72 and flow 85 pressurizes first and second leg portions 44' and 42' against first and second member surfaces 28A' and 30A', respectively. Third seal means 40' seals gap 32' between seal means 28' and 30' to reduce leakage between the two seal means. The widths of first and second leg portions 44' and 42' are preferably substantially equal to the widths W of the first and second seal means, respectively.

The abutting engagement between the third seal means 40' and seal means 28' and 30' seals leak path 32', yet permits independent movement of seal means 28' and 30' within their respective grooves, resulting in minimal coupling of motion between the first and second seal means. Therefore, motion of any one seal member due to relative motion or misalignment of adjacent nozzle segments will not tend to unseat the other seal members. Further, since the third seal means is not integral with either the first or second seal means, the third seal means does not stiffen either the first or second seal means, and maximum seal flexibility is maintained. Thus, first and second seal means 28' and 30' will be better able to conform to any surface roughness in the electro discharge machined surfaces of oppositely facing grooves 25' and 27' and grooves 24' and 26'.

The first and second seal means can have a common thickness between 0.006 inch and 0.008 inch, with a nominal value T (FIG. 8) of approximately 0.007 inch. This thickness is substantial enough to support the pressure differential acting across the first and second seal means, yet provides adequate first and second seal means flexibility.

The third seal means thickness, t, is preferably reduced relative to the first and second seal thickness T. In a preferred embodiment, the first and second seal means are between 0.006 inch and 0.008 inch thick, with a nominal thickness T of 0.007 inch (7 mils), and third seal means is between 0.0027 inch and 0.0033 inch thick, with a nominal thickness t of approximately 0.003 inch (3 mils), or no more than about half the nominal thickness T of the first and second seal means. Applicants have found that they can increase the flexibility of the seal assembly by substantially reducing the third seal means thickness relative to the first and second seal means thickness, yet the reduced third seal means thickness is sufficient to support the pressure differential across gap 32'. The increased flexibility of the third seal means permits the third seal means to better conform to the first and second seal means surfaces 28A' and 30A' for more effective sealing. Thicknesses T and t are not drawn to scale in FIG. 8.

The first, second, and third seal means are preferably formed from an alloy exhibiting good wear, corrosion and oxidation resistance at high temperatures, and is preferably a cobalt alloy such as L-605 conforming to AMS 5537. Applicants believe that a cobalt alloy has an additional advantage in that the inherit lubricity of the alloy minimizes resistance to sliding between seal members, resulting in minimal coupling of motion between the seal members. The first, second, and third seal means are preferably stamped, cut, or otherwise manufactured from sheet metal stock. In a preferred embodiment, the included angles A and A' (FIG. 8) between the first and second leg portions of the respective third seal members are between 60 degrees and 90 degrees, and the the bend radius at the junction of the first and second leg portions 42' and 44' (42 and 44) of the third seal means 40' (40) is nominally 0.006 inch.

FIG. 10 shows the three seal members 28', 30' and 40' in a perspective view of a nozzle segment outer band 16. As mentioned above, side surfaces 20' and 22' are typically angled or skewed with respect to the engine axis to accommodate the airfoil shape of vanes 18. In the embodiment shown in FIG. 10, leg portion 44' is skewed by an angle B' with respect to leg portion 42', where angle B' is substantially equal to the angle at which the side surfaces are skewed with respect to the engine axis. Thus, leg portion 44' will overlay seal member 28' and leg portion 42' will overlay seal member 30'. Angle B' can be approximately 45°.

Applicants have calculated that between 0.70% and 0.85% of the total core engine flow (also referred to as W25) which would otherwise be lost can be conserved by blocking both gaps 32' and 32 with the disclosed three-piece seal assembly. As a result, less parasitic cooling air will be required and engine efficiency will be increased.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope of the invention. For instance, the invention has been shown for sealing between adjacent high pressure turbine nozzle segments, but in another embodiment the three-piece seal assembly could be adapted to seal between other nozzle segments or between other circumferentially spaced-apart flowpath segments, such as a circumferentially spaced-apart shroud segments disposed radially outward of rotating turbomachinery blades.

Therefore, it is intended that the invention not be limited to the particular embodiment disclosed as the best mode contemplated for carrying out this invention, but that the invention will include all embodiments falling within the scope of the appended claims.

We claim:

1. A seal assembly for use in a gas turbine engine having a plurality of circumferentially spaced apart segments forming an annular flowpath boundary between a first region and a second region, the seal assembly comprising:

a. a first seal means separate from the segments and extending between adjacent segments;

b. a second seal means separate from the segments and the first seal means, and extending between adjacent segments and angled with respect to the first seal means; and c. a third seal means separate from the first and second seal means and the segments, and extending between adjacent segments and in abutting engagement with the first and second seal means to restrict flow between the first and second seal means wherein the third seal means is urged into abutting engagement with the first and second seal means by a pressure differential between the first region and the second region.

2. The seal assembly as recited in claim 1 wherein the third seal means includes a first leg portion abutting the first seal means and a second leg portion abutting the second seal means.

3. The seal assembly as recited in claim 1, wherein the third seal means has a nominal thickness substantially less than both a first seal means nominal thickness and a second seal means nominal thickness.

4. The seal assembly as recited in claim 2 wherein the first and second seal means are substantially flat and straight, and wherein the first and second leg portions are substantially flat and straight.

5. The seal assembly as recited in claim 3, wherein the third seal means nominal thickness is no more than about one-half both the first and second seal means nominal thicknesses.

6. A seal assembly for use in a gas turbine engine having a plurality of flowpath segments forming at least one segmented annular flowpath boundary between a relatively high pressure cooling fluid and a relatively lower pressure, higher temperature fluid flow, each pair of adjacent segments having at least one pair of oppositely facing surfaces, each pair of oppositely facing surfaces having a first pair of oppositely facing grooves and a second pair of oppositely facing grooves angled with respect to the first pair of grooves, respective grooves of the first pair intersecting respective grooves of the second pair, the seal assembly comprising;

a. a first seal means extending between and seated in the first pair of oppositely facing grooves to restrict flow of the cooling fluid between adjacent segments along a first direction;

b. a second seal means extending between and seated in the second pair of oppositely facing grooves to restrict flow of the cooling fluid between adjacent segments along a second direction; and c. third seal means disposed in the first and second groove pairs and having a first leg portion in abutting engagement with the first seal means and a second leg portion in abutting engagement with the second seal means for restricting flow between the first and second seal means wherein the third seal means is urged into abutting engagement with the first and second seal means by a pressure differential between the first region and the second region.

7. The seal assembly as recited in claim 6, wherein the third seal means has a nominal thickness substantially less than both a first seal means nominal thickness and a second seal means nominal thickness.

8. The seal assembly as recited in claim 6, wherein in the first and second seal means are substantially flat and straight, and wherein the third seal means first and second leg portions are substantially flat and straight.

9. The seal assembly as recited in claim 7, wherein the third seal means nominal thickness is less than or equal to one-half both the first seal means nominal thickness and the second seal means nominal thickness.

10. A seal assembly for use in a gas turbine engine having a plurality of flowpath segments forming at least one segmented annular flowpath boundary between a relatively high pressure cooling fluid and a relatively lower pressure higher temperature fluid flow, each pair of adjacent segments having at least one pair of oppositely facing surfaces, and each pair of oppositely facing surfaces having a first pair of oppositely facing grooves and a second pair of oppositely facing grooves angled with respect to the first pair of grooves, respective grooves of the first pair intersecting respective grooves of the second pair, the seal assembly comprising;

a. a substantially flat and straight first seal means extending between and seated in the first pair of oppositely facing grooves to restrict flow of the cooling fluid between adjacent segments along a first direction;

b. a substantially flat and straight second seal means extending between and seated in the second pair of oppositely facing grooves to restrict flow of the cooling fluid between adjacent segments along a second direction; and c. a third seal means for restricting flow between the first and second seal means, the third seal means including a substantially flat and straight first leg portion disposed in the first groove pair and in abutting engagement with the first seal means, and a substantially flat and straight second leg portion disposed in the second groove pair and in abutting engagement with the second seal means;

wherein the third seal means has a nominal thickness which is less than or equal to one-half a first seal means nominal thickness, and which is less than or equal to one-half a second seal means nominal thickness, and wherein the the third seal means has an included angle between the first and second leg portions between 60 degrees and 90 degrees wherein the third seal means is urged into abutting engagement with the first and second seal means by a pressure differential between the first region and the second region.

* * * * *